US009637960B2

(12) United States Patent
Caruso

(10) Patent No.: US 9,637,960 B2
(45) Date of Patent: May 2, 2017

(54) ENTRY SECURING APPARATUS AND METHODS THEREOF

(71) Applicant: Thomas C. Caruso, Freehold, NJ (US)

(72) Inventor: Thomas C. Caruso, Freehold, NJ (US)

( * ) Notice: Subject to any disclaimer, the term of this patent is extended or adjusted under 35 U.S.C. 154(b) by 245 days.

(21) Appl. No.: 14/144,218

(22) Filed: Dec. 30, 2013

(65) Prior Publication Data

US 2015/0184436 A1 Jul. 2, 2015

(51) Int. Cl.

| | |
|---|---|
| ***E05C 17/44*** | (2006.01) |
| ***E05C 19/00*** | (2006.01) |
| *E05C 19/18* | (2006.01) |

(52) U.S. Cl.

CPC ..... *E05C 19/005* (2013.01); *Y10T 292/65* (2015.04)

(58) Field of Classification Search

CPC ..... E05C 19/003; E05C 19/005; E05C 19/18; E05C 19/184; E05C 19/188

USPC ..... 292/338, 339, 289–294, 297, 298, 292/DIG. 15, 258; 16/82, 83

See application file for complete search history.

(56) References Cited

U.S. PATENT DOCUMENTS

| | | | | | |
|---|---|---|---|---|---|
| 1,055,941 | A * | 3/1913 | Morrison | E05C 19/182 | 292/294 |
| 1,165,895 | A * | 12/1915 | Nies et al. | E05C 19/182 | 292/294 |
| 1,598,081 | A * | 8/1926 | Japs | E05C 19/182 | 292/289 |
| 4,099,754 | A * | 7/1978 | Hoebing | E05C 5/04 | 292/206 |
| 4,838,589 | A * | 6/1989 | DiAmico | E05B 17/0025 | 16/220 |
| 5,704,662 | A * | 1/1998 | Kwiatkowski | E05B 17/2023 | 292/194 |
| 5,865,484 | A * | 2/1999 | Johns | E05C 19/182 | 292/288 |
| 6,149,209 | A * | 11/2000 | Barton | E05C 5/00 | 292/189 |
| 8,510,994 | B2 * | 8/2013 | Scott | E05B 9/08 | 292/289 |

* cited by examiner

*Primary Examiner* — Alyson M Merlino
(74) *Attorney, Agent, or Firm* — Michael P. Kochka, Esq.

(57) ABSTRACT

An entry securing apparatus for securing a door is provided that may comprise a rod secured to the door with one or more supports; a door block comprising a slot for receiving the rod and allowing the rod to pass through the door block, the door block moveable from a disengaged position to an engaged position, wherein the door block is in the engaged position when a portion of the door block is overlapping at least a portion of a door frame surrounding the door; and a fastener for securing the door block in the engaged position, whereby opening of the door is restricted by the door block.

17 Claims, 8 Drawing Sheets

ENTRY SECURING APPARATUS AND METHODS THEREOF

BACKGROUND OF THE INVENTION

Field of the Invention

Embodiments of the present invention generally relate to an entry securing apparatus and methods thereof. More specifically, embodiments of the present invention relate to an entry securing apparatus adapted to secure an entry and resist the entrance of an intruder.

Description of the Related Art

Recently the number of shooting events has increased, resulting in the tragic loss of many lives and serious injury to numerous individuals. In particular, many disturbing events have occurred in schools in which students have been unable to prevent the entrance of an intruder/gunman into classrooms. To prevent the entrance of intruders, a typical classroom door may have a door handle including a lock as the only method of securing a door. These locks can be easily bypassed by an intruder, however, when the intruder applies a significant force to the door and/or breaks a door window to gain access to the door lock. Intruders are often able to bypass these standard locks in a relatively short period of time, a period of time that often does not provide authorities sufficient time to counteract and neutralize the intruders. Delaying or preventing an intruder's entrance into a locked door or entrance may provide authorities with additional time and may reduce the number of tragic fatalities and/or serious injuries caused by shooting events.

Thus, there is a need for an improved entry securing apparatus adapted to secure an entry and resist the entrance of an intruder.

SUMMARY

Embodiments of the present invention generally relate to an entry securing apparatus for securing a door that may comprise a rod secured to the door with one or more supports; a door block comprising a slot for receiving the rod and allowing the rod to pass through the door block, the door block moveable from a disengaged position to an engaged position, wherein the door block is in the engaged position when a portion of the door block is overlapping at least a portion of a door frame surrounding the door; and a fastener for securing the door block in the engaged position, whereby opening of the door is restricted by the door block.

In another embodiment of the present disclosure, an entry securing apparatus for securing a door may comprise a rod secured to the door with one or more supports, the rod comprising a hinge allowing the rod to hinge toward the center of the door in a disengaged position and hinge away from the center of the door in an engaged position; a door block comprising: a first wing comprising a first slot for receiving the rod and allowing the rod to pass through the door block, the door block moveable from the disengaged position to the engaged position on a first side of the door, wherein the door block is in the engaged position when a portion of the door block is overlapping at least a first portion of a door frame surrounding the door; and a second wing comprising a second slot for receiving the rod and allowing the rod to pass through the door block, the door block moveable from the disengaged position to the engaged position on a second side of the door, wherein the door block is in the engaged position when a portion of the door block is overlapping at least a second portion of a door frame surrounding the door; a fastener for securing the door block in the engaged position, whereby opening of the door is restricted by the door block.

In yet another embodiment of the present disclosure, a method for using an entry securing apparatus for securing a door may comprise providing the entry securing apparatus, the entry securing apparatus comprising a rod secured to the door with one or more supports; a door block comprising a slot for receiving the rod and allowing the rod to pass through the door block, the door block moveable from a disengaged position to an engaged position, wherein the door block is in the engaged position when a portion of the door block is overlapping at least a portion of a door frame surrounding the door; and a fastener for securing the door block in the engaged position, whereby opening of the door is restricted by the door block; moving the door block into the engaged position; tightening the fastener and securing the door block in the engaged position.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
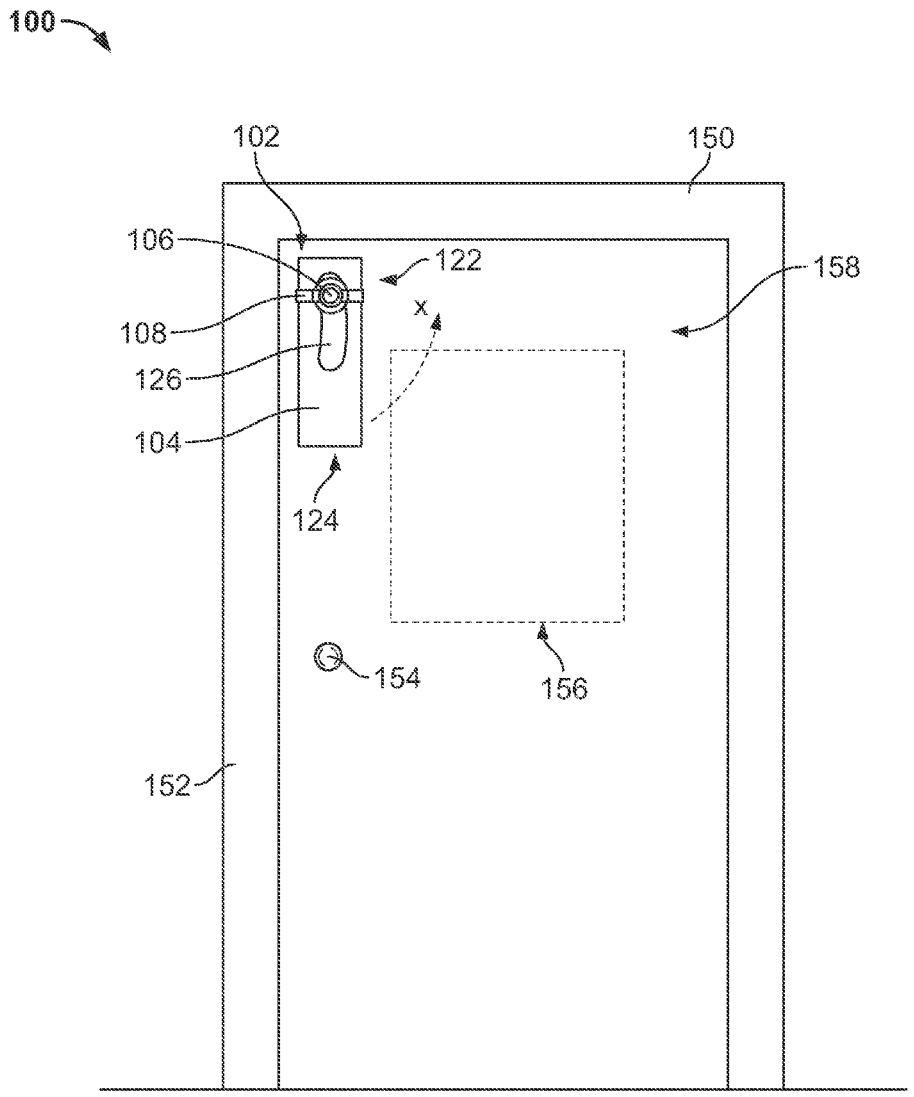
FIG. 1 depicts a front view of an entry securing system in a disengaged position in accordance with embodiments of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to an entry securing apparatus and methods thereof. More specifically, embodiments of the present invention relate to an entry securing apparatus adapted to secure an entry and resist the entrance of an intruder.

FIG. 1 depicts a front view of an entry securing system 100 in a disengaged position in accordance with embodiments of the present invention. In exemplary embodiments, an entry securing system 100 may comprise an entry securing apparatus 102 for securing and maintaining a door 158 in a closed position, whereby an intruder may be prevented, delayed, and/or deterred from entering a room enclosed by the door 158. The door 158 may generally be outward swinging, and may be housed within a frame. The frame may comprise a top portion 150 and a side portion 152, or the like. In some embodiments, a door 158 may comprise a window 156 and may be opened with a door handle 154, or the like.

Although various door handles 154 having one or more integral locks may be installed on a door 158, these locking door handles 154 may not provide adequate security. By way of example, when a door 158 includes a window 156, the window may be broken by an intruder, and the intruder may gain access to the mechanism that locks the door through the broken window, or the like, and unlock the door to gain entry. In some embodiments, handles 154 may include inferior locks that may be bypassed by applying a pulling force to the door. A securing apparatus 102 may provide additional security for the door, may substantially prevent the door from opening by pulling force, and may prevent or substantially delay an intruder from gaining access to an enclosed area.

In exemplary embodiments, an entry securing apparatus 102 may comprise a door block 104, a rod 106, a fastener 108 and/or the like. A door block 104 may be coupled with the rod 106 and may secure the door 158 in a closed position when the door block 104 is positioned over portions of the door frame 150, 152 and the fastener 108 is tightened. The door block 104 may comprise a top portion 122, a bottom portion 124, a slot 126 for receiving the rod 106, and/or the like. In some embodiments, the door block 104 may comprise a height between 4" and 16", or the like. For example, the door block 104 may comprise a height of 8". The slot 126 may comprise an aperture in the door block 104 that may comprise a size adapted to receive a rod 106, or the like. The rod 106 may be attached to the door 158, wherein when the door block 104 is moved into the engaged position overlapping a top portion 150 and a side portion 152 of the door frame, the door block 104 may substantially prevent the door 158 from being opened with a pulling force. In exemplary embodiments, the rod 106 may comprise a length between 5" and 20", or the like. For example, the rod 106 may comprise a length of 10". Although depicted as generally oval-shaped, the slot 126 can comprise alternative shapes, such as square, circle, rectangular, or the like, and may comprise notches for allowing the rod to rest and/or maintaining the rod at predetermined positions. Although one slot 126 is depicted in the figures, more than one slot may be used and may be located on different locations on the door block 104, such as the top portion 122 and/or the bottom portion 124. When an individual inside a room to be protected learns of an intruder, the individual may secure the door by moving the securing apparatus 102 from the disengaged position depicted in FIG. 1 to the engaged position depicted in FIG. 2, or the like, by sliding the door block 104 outwardly away from the door 158, rotating the door block 104 about the rod in the direction of arrow x, and sliding the door block 104 laterally such that the rod 106 slides within the slot 126 toward the bottom portion 124 of the door block 104.

Figure 2:
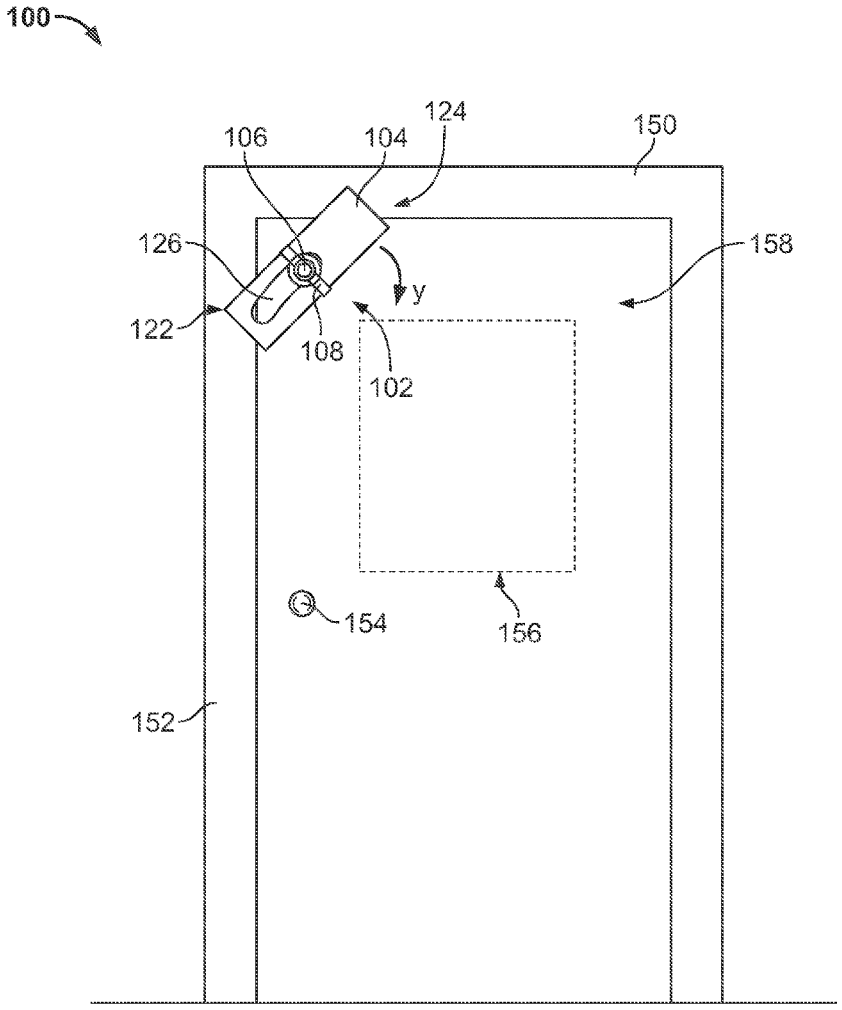
FIG. 2 depicts a front view of an entry securing system in an engaged position in accordance with embodiments of the present invention.

FIG. 2 depicts a front view of an entry securing system 100 in an engaged position in accordance with embodiments of the present invention. The door block 104 may be placed in the engaged position by placing a portion of the bottom portion 124 of the door block 104 in a position overlapping a portion of the top portion 150 of the door frame, placing a portion of the top portion 122 in a position overlapping a portion of the side portion 152 of the door frame, and securing the door block 104 in place by tightening a fastener 108. In exemplary embodiments, the rod 106 may be threaded and the fastener 108 may comprise an inversely threaded aperture adapted to couple with the rod 106. In some embodiments, the fastener 108 may comprise a tightening nut, a wingnut, a mechanism for securing the door block 104 in a tightened position whereby the door 158 may be restricted from opening, and/or the like. In some embodiments, the fastener 108 may comprise a washer and/or a wingnut that may be integral, attached, detached, and/or the like.

In exemplary embodiments, a fastener 108 may be adapted to apply a tightening force to the door block 104 and press the door block 104 against portions of the frame 150, 152, wherein the rod 106 is anchored and/or secured to the door 158. In some embodiments, the rod 106 may be integral with the door 158. If in an individual determines the door 158 may be reopened, for example, when it is determined a safety drill has been completed or the threat of an intruder has been eliminated, the individual may place the entry securing apparatus 102 back into the disengaged and/or stored position by untightening the fastener 108, rotating the door block 104 about the rod in the direction of arrow y, moving the door block 104 inwardly until it rests against the door 158, and sliding the door block 104 laterally such that the rod 106 slides within the slot 126 toward the top portion 122 of the door block 104. An exemplary entry securing apparatus 102 is depicted in greater detail in FIGS. 3-6. In some embodiments, a fixed support 112 may comprise a nut and a washer, which may be integral, attached, detached, and/or the like. The fixed support 112 may be fixed to the rod 106 in a fixed position. Although depicted in FIGS. 3-6 as a straight rigid rod 106, in some embodiments, such as the embodiment depicted in FIG. 8, the rod 106 may further comprise a hinge 860 or the like.

Figure 3:
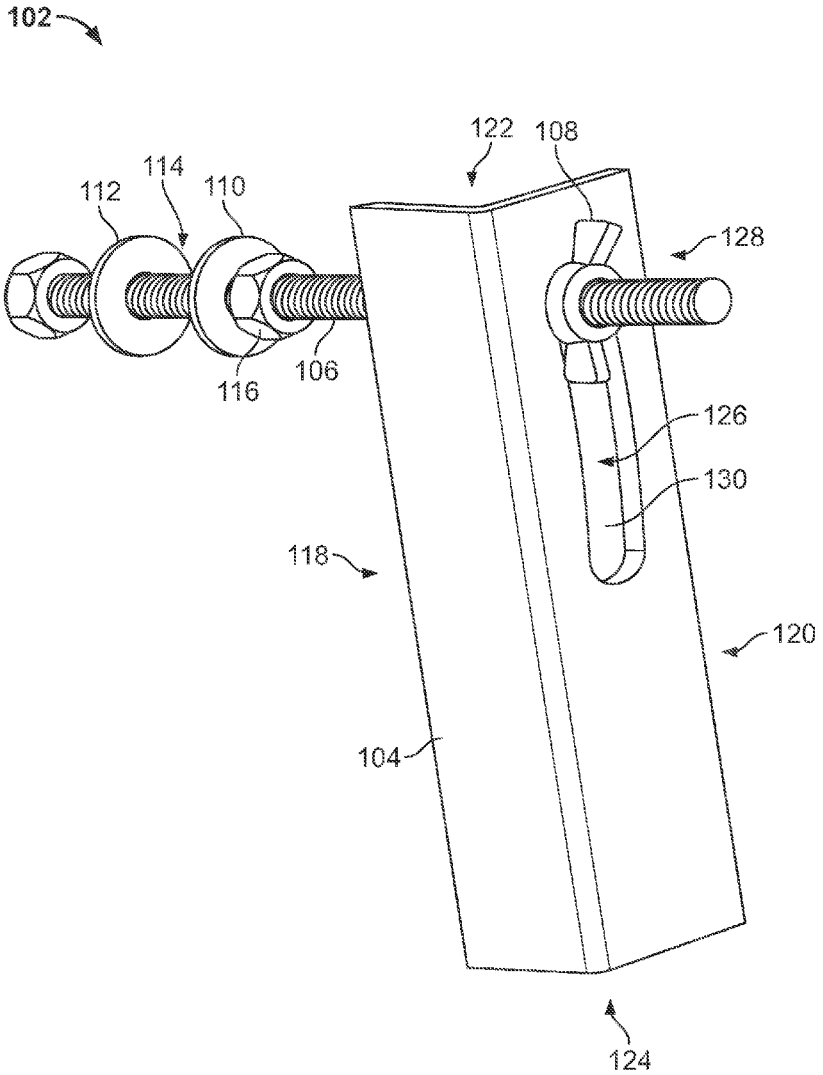
FIG. 3 depicts a perspective front view of an entry securing apparatus in accordance with embodiments of the present invention.

FIG. 3 depicts a perspective front view of an entry securing apparatus 102 in accordance with embodiments of the present invention. In exemplary embodiments, an entry securing apparatus 102 may comprise a door block 104, a rod 106, a fastener, 108, an adjustable support 110, a fixed support 112, a door space 114, an adjustment member 116, and/or the like. A door block 104 may comprise a first wing 118, a second wing 120, a top portion 122, a bottom portion 124, a slot 126, and/or the like. A slot 126 may comprise an upper slot portion 128 and a lower slot portion 130, wherein the upper slot portion 128 may be disposed closer to the top portion 122 of the door block 104 than the lower slot portion 130, and wherein the lower slot portion 130 may be disposed closer to the bottom portion 124 of the door block 104 than the upper slot portion 128.

In exemplary embodiments, the door block 104 may comprise wings 118, 120 that are generally rectangular in shape and connected at substantially a right angle, forming an "L" shape when viewed from the top. Although the wings 118, 120 are depicted as having a rectangular shape, other shapes, such as oval, triangle, square, or the like are contemplated by and within embodiments of the present disclosure. The door block 104 may comprise a material adapted to prevent a door from opening when force is applied to the door and the door block 104 overlaps a portion of a door frame, for example, an upper corner of a door. For example, the door block may comprise metal, steel, titanium, and/or the like. Although the door is depicted as having a handle on the left side and the door block depicted is configured for use with a door having a handle on the left side of the door, it is contemplated that the door block 104 may be configured for use with a door having a handle on the right side by reversing the positions of the elements of the entry securing apparatus 102 and/or adding an additional slot to the door block 104.

In exemplary embodiments, the door block 104 may generally comprise a first wing 118 that does not comprise an opening or slot and a second wing 120 that may comprise a slot 126 or opening for receiving a rod 106, or the like. In exemplary embodiments, the wings 118, 120 may be attached at a common edge. In some embodiments, the wings 118, 120 may be integral and may form an "L" shape when viewed from the top or bottom. The second wing 120 may be adapted to overlap a portion of a door frame and secure a door in place when the rod 106 is attached to a door. The first wing 118 may form a shelf underneath the rod and may guide the door block 104 into the proper position for engaging with the door frame, or the like. In some embodiments the first wing may be disposed adjacent the rod 106 underneath the rod 106 when the door block 104 is placed in the engaged position. In some embodiments, the rod 106 may be threaded and may be couple with an inversely threaded fastener 108. Although depicted as a wingnut in the Figures, alternative fasteners, such as a hexagonal nut, may be used. A fastener 108 may comprise a threaded hole and may be used in combination with a mating rod 106 to secure the door to the door frame, or the like.

In exemplary embodiments, an entry securing apparatus 102 may be integral with a door or may be secured to a door with supports 110, 112. For example, an entry securing apparatus 102 may comprise a fixed support 112 fixed at a distal end of the rod 106 and an adjustable support 110 slidably engaged with the rod 106. In some embodiments, the positioning of the fixed support 112 and the adjustable support 110, or the like may be reversed. In exemplary embodiments, the fixed support 112 may be fixed at a predetermined position on the rod 106. The fixed support 112 may be integral with the rod 106, may be attached or welded to the rod 106, and/or the fixed support 112 may be maintained in a fixed position by a fixing member (not shown), such as a nut, or the like.

In some embodiments, two adjustable supports 110 may be used. In some embodiments the supports 110, 112 may be adapted to maintain a door within a door space 114 between the supports 110, 112. In some embodiments, the door space may comprise a space sized for receiving a door. In some embodiments, the supports may comprise washers or the like. In some embodiments, the door may comprise slots or a locking mechanism for accepting the supports 110, 112 and maintaining them against the surface of the door. In some embodiments, the entry securing apparatus 102 may be secured to the door by placing the rod 106 through a hole in the door. The hole may be pre-formed with the door during the manufacturing process or may be made to any door, for example, by drilling. After the rod 106 is inserted into the hole in the door, the rod 106 may be secured to the door with the supports 110, 112. In some embodiments, the fixed support 112 may be present on the rod and the adjustable support 110 may be added after the rod 106 is placed through the hole in the door.

In some embodiments, both supports 110, 112 may be placed on the rod 106 after the rod 106 is placed through the hole in the door. In some embodiments, when the rod 106 is in place through the hole of the door, the supports 110, 112 may be used to secure the rod 106 to the door. The fixed support 112 may be placed flush against an outside portion of the door and the adjustable support 110 may be slid into position along the rod 106 to be flush with an inside portion of the door. The adjustable support 110 may be moved and/or secured into position flush against the inside portion of the door by tightening the adjustment member 116. In some embodiments, the adjustment member 116 may comprise a fastener with a threaded hole for engaging the threaded rod 106. The adjustment member 116 may be adapted to secure the door between the supports 110, 112 when tightened. In some embodiments, the adjustment member 116 may comprise a nut, or the like. In some embodiments, the adjustment member 116 may comprise a hexagonal shape, or the like. An adjustment member 116 may be hand tightened and/or tightened with a tool. In some embodiments, the adjustment member 116 may comprise a clamp, other locking mechanisms, and/or the like. In some embodiments, the fixed support 112 and/or adjustable support 110 may comprise an aperture sized to accept the rod 106. In some embodiments, the fixed support 112 and/or adjustable support 112 may comprise washers that are secured against the door, for example, with nuts or the like. Although the supports 110, 112 are depicted as circular in the Figures, other shapes, such as square, triangle, rectangle, hexagonal, and/or the like are contemplated by and within embodiments of the present disclosure.

In some embodiments, the rod 106 may comprise a substantially rigid material of sufficient strength to resist breaking when a pulling force, or the like, is applied to a door attached to the rod 106. In some embodiments, the rod 106 may comprise steel, titanium, and/or the like. A rod 106 may comprise a threaded portion, a track, or the like, for engaging at least one of a support 110, 112, an adjustment member 116, and/or a fastener. In some embodiments, the rod 106 may be telescoping and lockable (not shown) and/or may comprise a hinge for placing the rod 106 in a stored position and reducing the protrusion of the entry securing apparatus 102 into the room to be secured.

Figure 4:
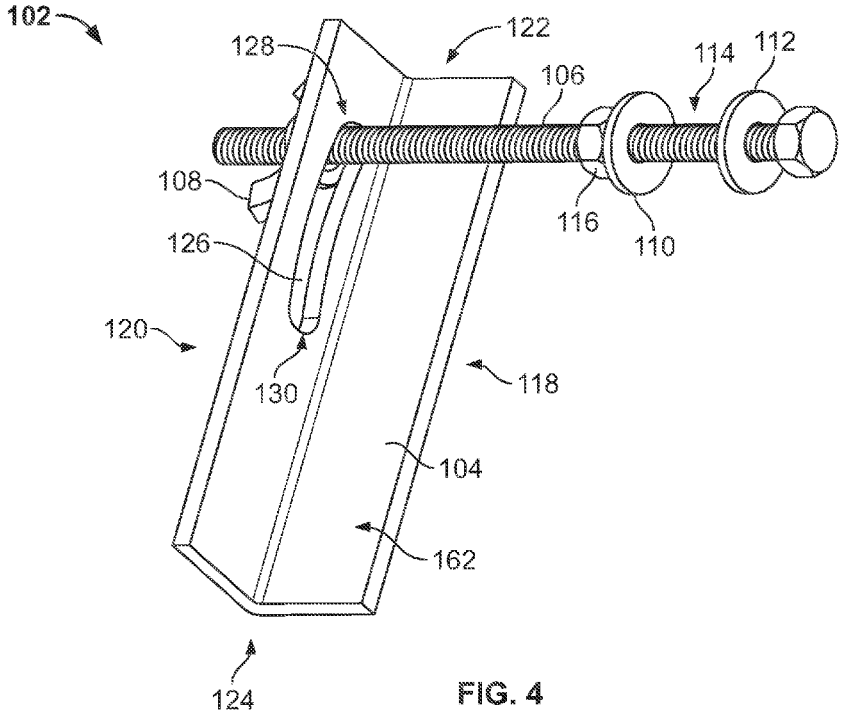
FIG. 4 depicts a perspective back view of an entry securing apparatus in accordance with embodiments of the present invention.

FIG. 4 depicts a perspective back view of an entry securing apparatus 102 in accordance with embodiments of the present invention. The entry securing apparatus 102 may comprise an interior portion 162 that may generally face the inside portion of the door to be secured. In exemplary embodiments, sections of the interior portion 162 of the second wing 120 may be placed flush against portions of a door frame when the entry securing apparatus 102 is to be placed in the engaged position, as depicted in FIG. 2. An interior portion 162 of the first wing 118 may rest against the rod 106 and be used as a guide and/or support for the door block 104 to place it in the correct position flush against portions of the door frame. In some embodiments, when the interior portion 162 of the second wing 120 of the door block 104 is flush against and overlapping portions of the top and the side of a door frame, the door block 104 may be secured into position by tightening the fastener 108. In some embodiments, when the door block 104 is secured into position against the door frame, the first wing 118 may generally be disposed within a space between the door and the outermost portion of the door frame, or the like.

Although depicted as a wingnut, the fastener 108 may comprise a clamp or other locking mechanism adapted to secure the door block 104 against a portion of the door frame. In some embodiments, the fastener 108 may comprise a lock that may be locked/unlocked with a key, or the like. In some embodiments, additional locks may be placed on the rod to secure the door block 104 into position. For example, locks requiring keys, RFID authentication, biometric security authentication, and/or the like may be included to secure the door block 104 to a portion of the door frame. Although depicted as having an elongated slot 126, in some embodiments, the rod 106 may simply protrude through an opening slightly larger than the circumference of the rod. Although the rod is depicted as rounded, in some embodiments, the rod 106 may comprise a different shape, such as a square, triangle, and/or the like. In some embodiments, more than one of each of the components listed herein may be used. For example, more than one entry securing apparatus 102 may be included and used on different portions of a door. In some embodiments, each entry securing apparatus 102 may comprise more than one door block 104, rod 106, fastener 108, adjustable support 110, fixed support 112, adjustment member 116, slot 126, and/or the like.

Figure 5:
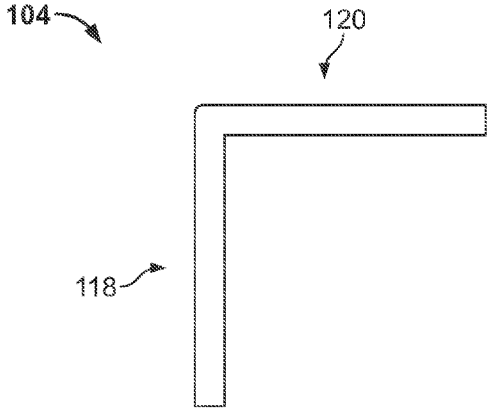
FIG. 5 depicts a perspective top view of a door block in accordance with embodiments of the present invention.

FIG. 5 depicts a perspective top view of a door block 104 in accordance with embodiments of the present invention. In exemplary embodiments, a door block 104 may comprise a first wing 118 and a second wing 120 connected at a common edge at a right angle, and/or the like. In some embodiments, the first wing 120 and the second wing 120 may be connected at a rounded connection, and/or the like. When the entry securing apparatus 102 is secured in an engaged position, the first wing 118 may be disposed in a space between the inside of the door and the innermost portion of the door frame in relation to the room to be secured, and a portion of the second wing 120 may overlap a portion of the top and the side portions of a door frame on the innermost portions of the door frame in relation to the room to be secured.

Figure 6:
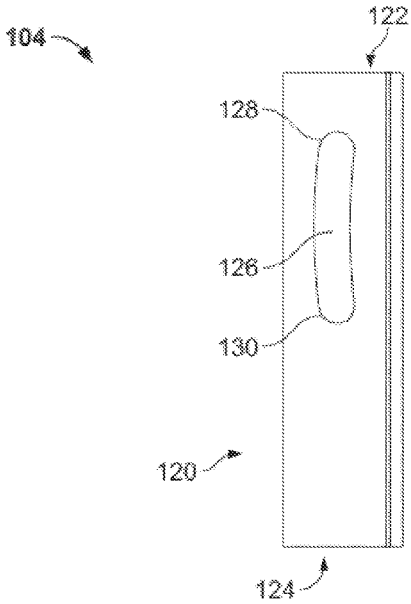
FIG. 6 depicts a side view of a door block in accordance with embodiments of the present invention.

FIG. 6 depicts a side view of a door block 104 in accordance with embodiments of the present invention. In accordance with exemplary embodiments, the door block 104 may comprise a slot 106 comprising an upper slot portion 128 and a lower slot portion 130. When the entry securing apparatus 102 is in the disengaged position, a curved portion of the upper slot portion 128 of the door block 104 may generally rest on the top portion of the rod attached to the door, thereby supporting the weight of the door block 104 on the rod and allowing the door block 104 to hang. In some embodiments, an additional securing member (not shown) may be included to prevent the door block from swinging when in the disengaged position. For example, hook and loop fasteners, straps, or the like may be used to secure the door block 104 and prevent it from swinging and damaging the door, interfering with the normal operation of the door, or causing injury to others. In some embodiments, the fastener 108 may be used to secure the door block 104 in a position against the door in a disengaged position, wherein the first wing 118 is secured against the door.

In exemplary embodiments, when the entry securing apparatus 102 is in the engaged position, a curved portion of the lower slot portion 130 of the door block 104 may generally be disposed against a portion of the bottom of a rod attached to the door. A slot 126 may generally comprise a size suitable for accepting a rod, or the like, in accordance with exemplary embodiments, and allowing the rod to freely slide within the length of the slot 126. A slot 126 may be positioned on the door block 104 such that when the rod is disposed against the lower slot portion 130, the door block is in an ideal or correct position for engaging with a top and a side portion of a door frame. In exemplary embodiments, the slot 126 may be adapted to allow the door block 104 to freely rotate about an axis passing through the center of the rod, or the like.

Figure 7:
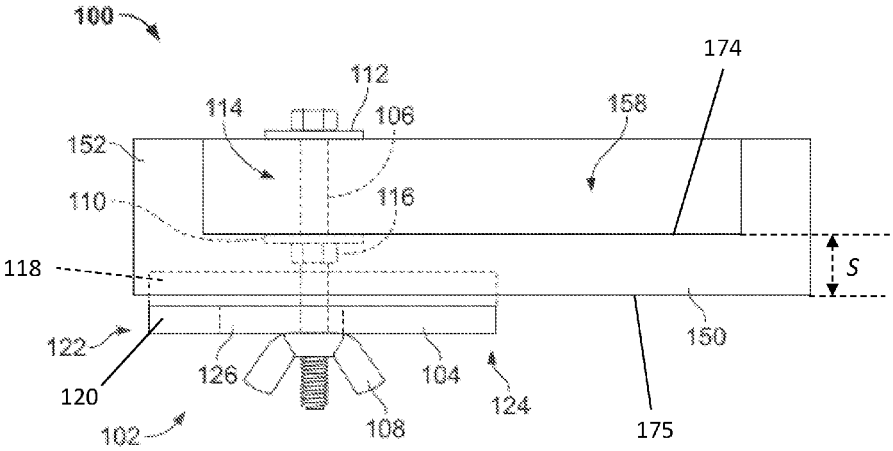
FIG. 7 depicts a top view of an entry securing system in accordance with embodiments of the present invention.

FIG. 7 depicts a top view of an entry securing system 100 in accordance with embodiments of the present invention. An exemplary rod 106, adjustable support 110, adjustment member 116, and portion a door block 104 are depicted in phantom to indicate the rod 106 passes through the door 158 and the adjustable support 110, adjustment member 116, and a portion of the door block 104 are disposed under the a lip of a top portion 150 of a door frame. As can be seen in FIG. 7, a door front surface 174 is separated from a frame front surface 175 and a space S exists between the door front surface 174 and the frame front surface 175. The space S under the top portion 150 creates a lip or overhang over the door 158. When the door block 104 is in the engaged position, as shown in FIG. 7, a portion of the first wing 118 is disposed in the space S under the top portion 150 in front of the door front surface 174 and a portion of the second wing 120 is disposed on a portion of the frame front surface 175. In exemplary embodiments, the rod 106 is secured to the door 158 with a fixed support 112 disposed flush against the door 158 on an outside surface of the door 158 and an adjustable support 110 disposed flush against the door 158 on an inside surface of the door 158. The rod 106 may generally pass through a hole in the door 158. The door 158 may be supported in a door space 114 between the fixed support 112 and an adjustable support 110. In some embodiments, after the rod 106 is placed through the hole in the door 158, the rod may be secured to the door by tightening the adjustment member 116 so that both supports 110, 112 are tightened against the door 158. In some embodiments, when the entry securing apparatus 102 is placed in an engaged position 102, the rod 106 may be disposed through the slot 126 and the door block 104 may be secured against a top portion 150 and a side portion 152 of a door frame by tightening the fastener 108, or the like. In some embodiments, when in an engaged position, the bottom portion 124 of the door block 104 may be rotated about the rod 106 and placed in a position overlapping a portion of the top portion 150 of the door frame, wherein the top portion 122 of the door block 104 may be placed in a position overlapping a portion of the side portion 152 of the door frame. In exemplary embodiments, when in an engaged position, a portion of the door block 104, such as a first wing may be disposed under a lip a door frame and between two side portions of the door frame. As such, when an intruder, or the like, attempts to pull the door 158 open, the pulling and opening of the door 158 is resisted by the door block 104 secured flush against the top portion 150 and side portion 152 of the door frame.

Figure 8A:
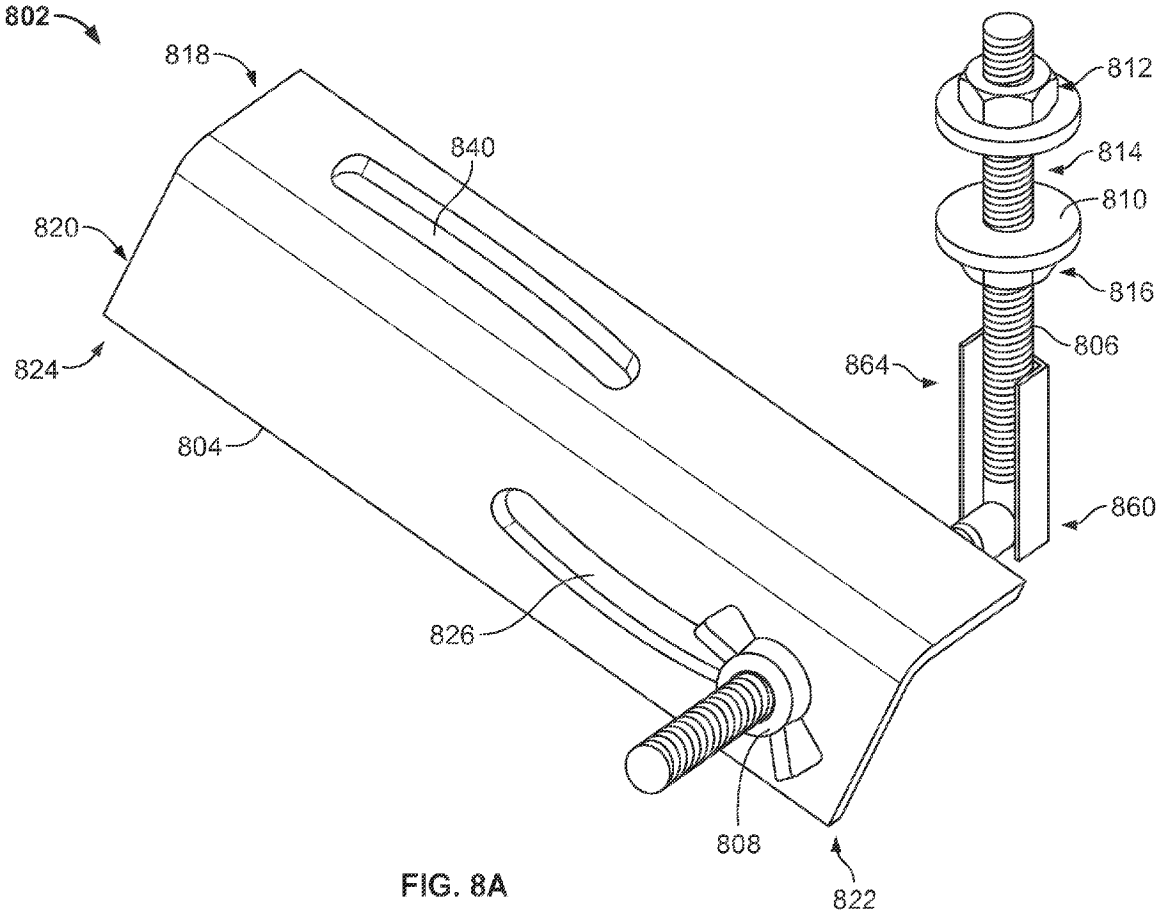
FIG. 8A depicts a perspective front view of an entry securing apparatus in an disengaged position in accordance with embodiments of the present invention.
Figure 8B:
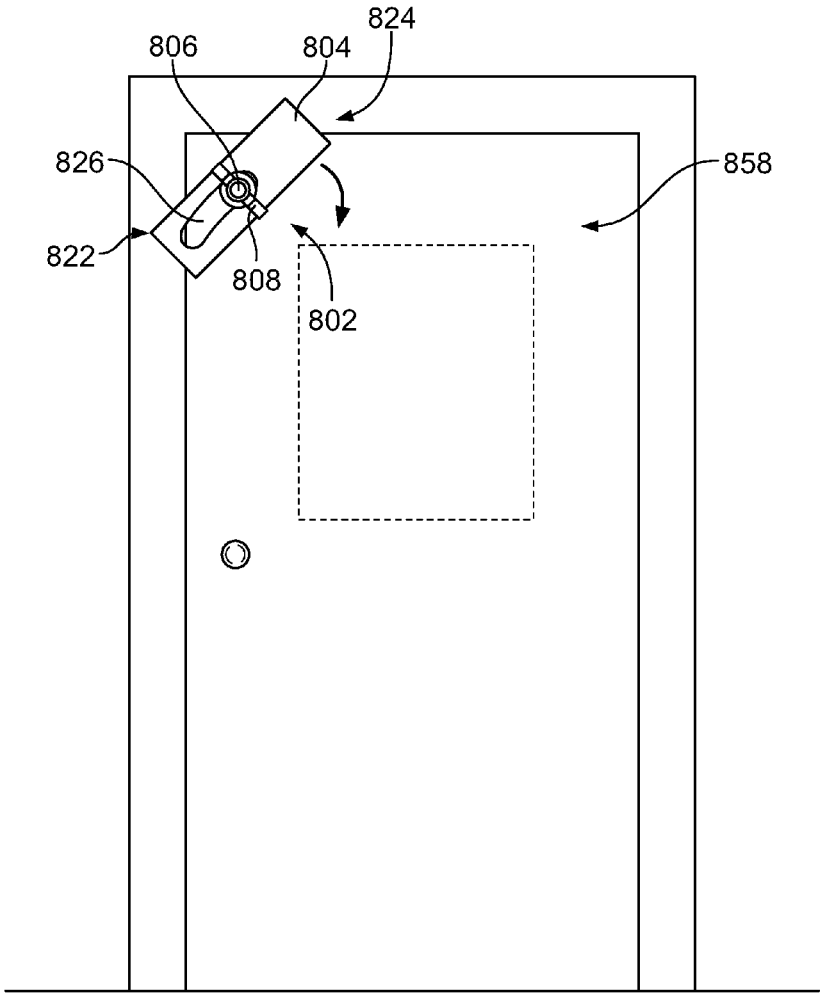
FIG. 8B depicts a perspective view of an entry securing apparatus in an engaged position securing a door, in accordance with embodiments of the present invention.

FIG. 8A depicts a perspective front view of an entry securing apparatus 802 in an disengaged position in accordance with embodiments of the present invention. FIG. 8B depicts a perspective view of an entry securing apparatus 802 in an engaged position securing a door 858, in accordance with embodiments of the present invention. An entry securing apparatus 802 may generally comprise a door block 804, fastener 808, adjustable support 810, fixed support 812, door space 814, adjustment member 816, first wing 818, second wing 820, top portion 822, bottom portion 824, a slot 826, and/or the like that are described with respect to the door block 104, fastener 108, adjustable support 110, fixed support 112, door space 114, adjustment member 116, first wing 118, second wing 120, top portion 122, bottom portion 124, slot 126, and/or the like, described in FIGS. 1-7 above. In addition the securing apparatus 802 may further comprise a second slot 840 and a rod 806 comprising a hinge 860. When in the engaged position securing the door 858, the entry securing apparatus 802 functions exactly the same as the entry securing apparatus depicted and described with respect to FIG. 2. The rod 806 may be straightened via the hinge 860 in a manner such that the rod 806 functions exactly like, and looks substantially like, the rod 106 depicted in FIG. 3. In exemplary embodiments, the second slot 840 may comprise the same dimensions as a first slot 826, but may be positioned on the first wing 118 for allowing the entry securing apparatus 802 to be secured to the opposite side of the door and/or a door with a handle on the opposite side of the door, or the like.

In exemplary embodiments, the rod 806 may comprise a hinge 860 that may allow a distal portion of the rod to collapse, for example, at a right angle, toward the door when the entry securing apparatus 802 is placed in a disengaged and/or stored position. In some embodiments, the rod 806 may be coupled with, and/or welded to, a hinged in rest post 864 adapted to act as a stop to prevent the hinge 860 from moving past a predetermined point. In some embodiments, a rod 806 may comprise two pieces, each attached to the rest post 864. For example, the rod 806 may comprise a first portion connected to the rest post and a second portion comprising a hinge 860 connected to the rest post, wherein the two portions of the post are connected via the rest post and are not directly connected to one-another. In some embodiments, the rod 806 may comprise a roll pin for a hinge pivot. In some embodiments the hinge 860, or the like, may allow a portion of the rod 806 to hinge toward the center of the door, or the like. When the entry securing apparatus 802 is placed in an engaged position the rod may be placed in an unhinged or straightened configuration and/or secured in a straightened position with a straightener adapted to slide over the hinge 860 and prevent the hinge 806 from collapsing the rod and/or maintaining the rod 806 in a straightened position. In some embodiments, the securing apparatus 802 may comprise a lock for locking the hinge 860 in a straightened position when the entry securing apparatus 802 is in an engaged position, or the like.

The shapes, sizes, dimensions, positioning, and number of elements depicted in the figures are meant for exemplary purposes only. Alternative shapes, sizes, dimensions, positioning, and number of elements, including duplicate elements, are contemplated by and within embodiments of the present disclosure. In some embodiments, a lock requiring a key may be included in the entry securing system 100, which may prevent the entry securing apparatus 102 from becoming disengaged without the key.

In some embodiments, alternative security measures, such as biometric security measures, key FOBs, RFID readers/chips, voice activated passwords, password protected keypads, and/or the like, may be included for locking the entry securing apparatus into position. In some embodiments, one or more components described herein may be activated via an electronic system. For example, a button, lever, or the like may be present within the room to be secured. The button, lever, or the like may be configured to electrically activate the entry securing apparatus when activated. In addition, a central command device may be adapted to lock and/or unlock one or more entry securing apparatus in one or more buildings, or the like. In some embodiments, the central command device may be secured with a password, a key, and/or the like. In some embodiments, the entry securing system 100 may be activated or deactivated over a computer system or the like. For example, the entry securing system 100 may be activated over the internet using an internet-connected device, such as a computer, a mobile device, a smartphone, and/or the like.

In some embodiments, the securing system 100 may be activated via remote control, or the like. In some embodiments, the entry security system may comprise a means for communicating with an individual operating a central command device, such that the individual may be provided a verbal password, or the like, for authorization to activate and/or deactivate the entry securing system 100. In some embodiments, action by two users, for example, unlocking the device with two keys on separate sides of the door, may be required to deactivate the entry securing system 100 and/or place the entry securing apparatus 102 in a disengaged state. In some embodiments, when the entry securing apparatus 102 is placed in an engaged state, the entry securing system 100 may be adapted to activate an alert, sound and alarm, transmit an alert, notify predetermined users and/or the authorities, activate one or more security cameras, and/or the like.

Figure 9:
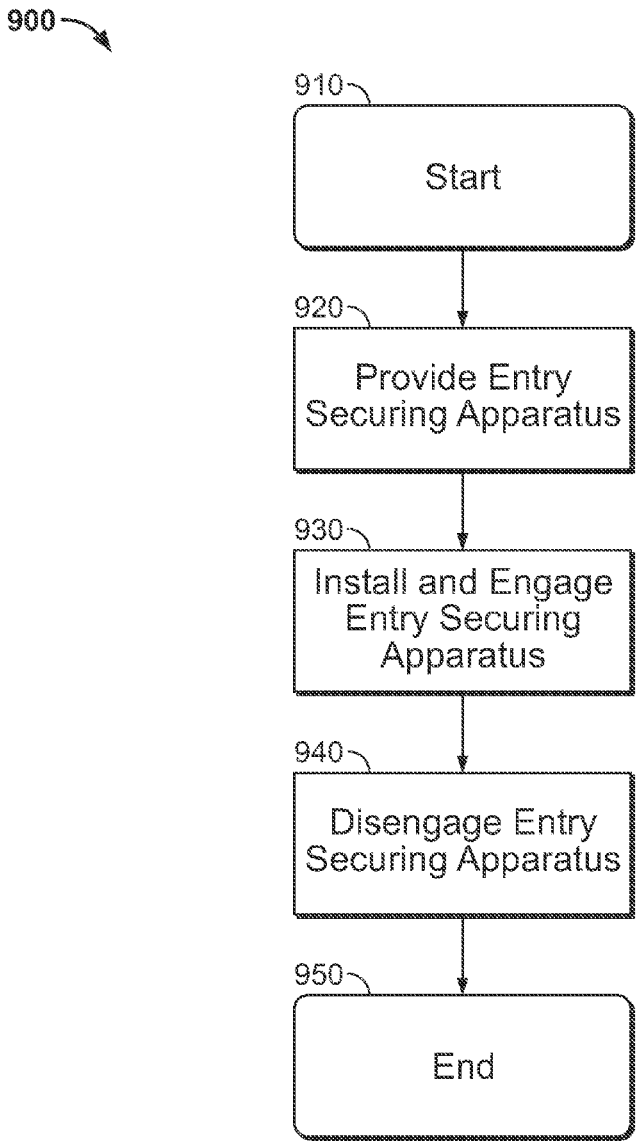
FIG. 9 depicts a flow diagram illustrating an exemplary method for using an entry securing system in accordance with embodiments of the present invention.

Referring now to FIG. 9, a flow diagram illustrating an exemplary method for using an entry securing system in accordance with embodiments of the present invention is depicted. The method begins at step 910. For ease, the method 900 is described herein with reference to the securing entry securing apparatus 102 examples illustrated in FIGS. 1-8. At step 920, an entry securing apparatus 102 is provided. In exemplary embodiments, the securing entry securing apparatus 102 may comprise a door block 104, a rod 106, a fastener 108, an adjustable support 110, a fixed support 112, a door space 114, an adjustment member 116, and/or the like. The door block 104 may comprise a first wing 118, a second wing 120, a top portion 122, a bottom portion 124, and a slot 126 having an upper slot portion 128 and a lower slot portion 130.

In exemplary embodiments, at step 930 the entry securing apparatus may be installed and engaged. A hole may be made in an upper corner of an out-swinging door on the side of the door closest to the door the door handle. The rod 106 may be placed in the hole and the door may be secured within the door space 114 with the supports 110, 112, and/or the adjustment member 116. The door block 104 may be placed on the rod 106 by placing the rod through the slot 126 and the fastener 108 may be secured on the distal end of the rod 106.

When the entry securing apparatus 102 is to be placed in the engaged position, the door block 104 may be rotated about the rod 106 and slid away from the door along the rod 106 such that a portion of the bottom portion 124 of the door block 104 is overlapping a portion of a top portion 150 of a door frame and a portion of the top portion 122 of the door block 104 is overlapping a portion of a side portion 152 of a door frame. After the door block 104 is rotated and slid on the rod 106, the door block 104 may be secured against the door frame by tightening the fastener 108 at which point the entry securing apparatus is in the engaged position. At step 940, the entry securing apparatus 102 may be disengaged. To disengage the entry securing apparatus 102, the fastener 108 may be loosened and the door block 104 may be rotated about the rod 106 and moved toward the door, such that the bottom portion 124 of the door block 104 is placed closer to the handle than the top portion 122 of the door block, wherein a curved portion of the upper slot portion 128 rests on the rod 106 and supports the weight of the door block 104. After the entry securing apparatus 102 has been disengaged, the method ends at step 950.

While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. An entry securing apparatus comprising:

a rod having one or more supports for securing the rod to a door;

a door block comprising a slot for receiving a portion of the rod and allowing the portion of the rod to pass through the door block, the door block moveable from a disengaged position to an engaged position, wherein the door block is in the engaged position when a top portion of the door block overlaps a side portion of a door frame surrounding the door and a bottom portion of the door block overlaps a top portion of the door frame; and a fastener for securing the door block in the engaged position, whereby opening of the door is restricted by the door block;

wherein the top portion of the door block is above a vertical position of the rod in the disengaged position and below the vertical position of the rod in the engaged position; and wherein the bottom portion of the door block is below the vertical position of the rod in the disengaged position and above the vertical position of the rod in the engaged position.

2. The entry securing apparatus of claim 1, wherein the door block is moveable from the disengaged position to the engaged position by rotating the door block about the rod, moving the door block outwardly away from a surface of the door, overlapping the top portion of the door block with the side portion of the door frame, overlapping the bottom portion of the door block with the top portion of the door frame, and securing the fastener.

3. The entry securing apparatus of claim 1, wherein the door block comprises a first wing and a second wing, and the slot is disposed ft in the second wing.

4. The entry securing apparatus of claim 3, wherein the first wing and the second wing are attached along a common edge at a right angle.

5. The entry securing apparatus of claim 3, wherein the first wing is positioned under a lip of the door frame when the door block is in the engaged position; and wherein the second wing comprises the top portion and the bottom portion of the door block.

6. The entry securing apparatus of claim 1, wherein the portion of the rod comprises a threaded outer surface and the fastener comprises an opening having an inversely threaded inner surface for coupling with the threaded surface of the portion of the rod.

7. The entry securing apparatus of claim 1, wherein the fastener comprises a wingnut.

8. The entry securing apparatus of claim 1, wherein the one or more supports comprises:

a fixed support attached to an end portion of the rod in a fixed location flush with a first side of the door;

an adjustable support moveably attached to the rod on a second side of the door; and an adjustment member for moving the adjustable support along the rod and securing the adjustable support to a position flush with the second side of the door.

9. The entry securing apparatus of claim 8, wherein the adjustable support comprises a washer having an aperture for receiving the rod; and wherein the adjustment member comprises a nut for tightening the washer against the second side of the door, whereby the rod is secured to the door.

10. An entry securing apparatus for securing a door, the entry securing apparatus comprising:

a door block moveable between a disengaged position and an engaged position;

a rod secured to the door with one or more supports, the rod comprising a hinge such that a portion of the rod is hinged toward a center portion of the door when the door block is in the disengaged position and the portion of the rod is hinged away from the center portion of the door when the door block is in the engaged position; and a fastener for securing the door block in the engaged position such that opening of the door is restricted by the door block;

wherein the door block comprises:

a first wing comprising a first slot and a second wing comprising a second slot, wherein when the door block and rod are positioned on a first side of the door, the portion of the rod passes through the first slot of the door block such that the door block is moveable from the disengaged position to the engaged position, wherein when the door block is in the engaged position on the first side of the door, a portion of the door block overlaps at least a first portion of a door frame surrounding the door, restricting the opening of the door; and wherein when the door block and rod are positioned on a second side of the door, the portion of the rod passes through the second slot of the door block such that the door block is moveable from the disengaged position to the engaged position, wherein when the door block is in the engaged position on the second side of the door, a portion of the door block overlaps at least a second portion of the door frame surrounding the door, restricting the opening of the door;

wherein the door block comprises a top portion and a bottom portion;

wherein the top portion is above a vertical position of the rod in the disengaged position and below the vertical position of the rod in the engaged position; and wherein the bottom portion is below the vertical position of the rod in the disengaged position and above the vertical position of the rod in the engaged position.

11. The entry securing apparatus of claim 10, wherein the door block is moveable from the disengaged position to the engaged position by rotating the door block about the rod, moving the door block outwardly away from a surface of the door, overlapping the top portion of the door block with a side portion of the door frame, overlapping the bottom portion of the door block with a top portion of the door frame, and securing the fastener.

12. The entry securing apparatus of claim 10, wherein the first wing and the second wing are attached along a common edge at a right angle.

13. The entry securing apparatus of claim 10, wherein the portion of the rod comprises a threaded outer surface and the fastener comprises an opening having an inversely threaded inner surface for coupling with the threaded surface of the portion of the rod.

14. The entry securing apparatus of claim 10, wherein the fastener comprises a wingnut.

15. The entry securing apparatus of claim 10, wherein the one or more supports comprises:

a fixed support attached to an end portion of the rod in a fixed location flush with a first side of the door;

an adjustable support moveably attached to the rod on a second side of the door; and an adjustment member for moving the adjustable support along the rod and securing the adjustable support to a position flush with the second side of the door.

16. A method for using an entry securing apparatus for securing a door, the method comprising:

providing the entry securing apparatus, the entry securing apparatus comprising:

a rod having one or more supports for securing the rod to the door;

a door block comprising a slot for receiving a portion of the rod and allowing the portion of the rod to pass through the door block, the door block moveable from a disengaged position to an engaged position, wherein the door block is in the engaged position when a first portion of the door block overlaps a side portion of a door frame surrounding the door and a second portion of the door block overlaps a top portion of the door frame; and a fastener for securing the door block in the engaged position, whereby opening of the door is restricted by the door block;

securing the rod to the door and sliding the portion of the rod through the slot;

moving the door block into the engaged position; and tightening the fastener and securing the door block in the engaged positions;

wherein the door block comprises a top portion and a bottom portion;

wherein the top portion is above a vertical position of the rod in the disengaged position and below the vertical position of the rod in the engaged position; and wherein the bottom portion is below the vertical position of the rod in the disengaged position and above the vertical position of the rod in the engaged position.

17. The method of claim 16, further comprising:

loosening the fastener and releasing the door block from the engaged position;

moving the door block into the disengaged position, wherein no portion of the door block is overlapping the door frame surrounding the door.

* * * * *